United States Patent [19]

Mark

[11] 4,453,631

[45] Jun. 12, 1984

[54] PHONOGRAPH RECORD ALBUM AND SLIP CASE

[75] Inventor: Frederick K. Mark, Lebanon, Pa.

[73] Assignee: Lebanon Packaging Corporation, Jonestown, Pa.

[21] Appl. No.: 432,654

[22] Filed: Dec. 16, 1982

[51] Int. Cl.[3] ..... B65D 85/30; B65D 85/57

[52] U.S. Cl. ..... 206/313; 206/309; 229/9; 229/19

[58] Field of Search ..... 206/307, 309, 310, 311, 206/312, 313; 229/9, 19, 23 R, 23 BT, 40, 44 CB, 68 R, 87 R, 87 C, DIG. 15

[56] References Cited

U.S. PATENT DOCUMENTS

| | | | |
|---|---|---|---|
| 1,946,516 | 2/1934 | Zalkind | 229/19 |
| 2,128,341 | 8/1938 | Zalkind . | |
| 2,128,342 | 8/1938 | Zalkind . | |
| 2,229,425 | 1/1941 | Tanner . | |
| 2,776,081 | 1/1957 | Ringler . | |
| 2,917,219 | 12/1959 | Schimel . | |
| 3,302,844 | 2/1967 | Henry | 229/19 |
| 3,949,928 | 4/1976 | Perkins . | |
| 3,957,320 | 5/1976 | Walter | 229/19 |
| 4,125,189 | 11/1978 | Fujimoto . | |
| 4,339,034 | 7/1982 | Panveno | 206/313 |

FOREIGN PATENT DOCUMENTS

| | | | |
|---|---|---|---|
| 655305 | 1/1963 | Canada | 229/44 CB |
| 1345451 | 1/1974 | United Kingdom | 229/40 |

*Primary Examiner*—George E. Lowrance
*Assistant Examiner*—Jimmy G. Foster
*Attorney, Agent, or Firm*—C. Hercus Just

[57] ABSTRACT

A record album and slip case cut and folded from sheet paper board stock to provide a relatively flat box-like container having similar side panels spaced apart a limited distance and having one open end provided with a relatively long access notch extending inward from the edges of the side panels of said container in which the access notch is formed and bounded therealong by smooth reinforced edges resulting from tongues of the material folded inwardly upon the inner surfaces of the side panels and secured thereto by adhesive, certain of the tongues being of substantial size to afford protective stiffness to a substantial area of the side panels extending inward from the edges of the access notches, whereby no raw board edges appear on the boundaries of the open end and access notches therein. The slip case also is formed from similar board stock and is of a flat shape complementary to the container and adapted to slidably receive the same through one open end and the edges of the panels defining the same being reinforced by narrow panels folded inwardly upon and secured to the side and edge panels of the case by adhesive, thereby providing smoothly rounded edges along the open end resulting from such folding of the narrow panels.

9 Claims, 4 Drawing Figures

PHONOGRAPH RECORD ALBUM AND SLIP CASE

BACKGROUND OF THE INVENTION

The present invention pertains to a phonograph record album and slip case in which the album actually is a relatively flat box-like container having similar side panels spaced apart a limited distance and having one open end provided with relatively long access notches extending inward from the edges of the side panels of the container to facilitate the engagement of records when disposed therein, and a slip case which is complementary in size and shape to the container also has one open end, the box-like container and slip case both being made from sheet-type paper board stock of suitable thickness, blanks from which the container and slip case are formed being suitably cut or stamped from such sheet stock and various panels thereof are folded and connected together to form the finished products.

Forming various types of boxes and containers from paper board sheet stock is quite old and in recent years, in which the packaging industry has grown to enormous proportions, the formation of numerous types of container has been the subject of many patents. There are a number of primary objectives in forming cartons and containers from such sheet stock, one of the principal objectives being to form blanks from sheet stock in which there is a minimum amount of waste and as much of the sheet stock as possible is used in the formation of the desired product.

Other objectives are to form various cases, boxes and the like from sheet stock in which various panels are folded in certain ways and upon each other to strengthen the finished product. For purposes of facilitating the shipment of such containers prior to ultimate use thereof, it has also been an extensive practice to ship such cartons in blank condition and folding the same into the finished product occurs at the location where the containers are to be used. It also has been quite common to utilize adhesive in various ways to form the finished product and render it stable and rigid.

Other objectives in the industry have been to form containers having various characteristics and shapes to facilitate the use thereof in holding certain types of products, including cases to contain and protect such items as phonograph records and tape cassettes. To adapt the case or container for such use, it is desirable to have notches extending inwardly from an open end or side of the container in order that the phonograph record or cassette may be engaged readily along one edge to remove the same from the container. Forming notches of this type in certain kinds of boxes and other forms of containers is not now. Although not adapted to contain phonograph records and cassettes, a number of boxes and containers have been developed which have notches in an open end or side thereof to facilitate the engagement of items to be contained in the same. For example, prior U.S. Pat. Nos. 2,128,341 and 2,128,342, to Zalkind, both dated Aug. 30, 1938, pertain to containers in the nature of file drawers for cards or other similar item, the opposite sides of the container having elongated notches extending thereinto, the containers, being formed from sheet paper stock and blanks, are suitably creased or incised to preform certain foldable panels and the like which result in formation of the finished box-like structure.

Another container similar to the Zalkind containers comprises the subject matter of prior U.S. Pat. No. 2,229,425 to Tanner, dated Jan. 21, 1941, in which opposite ends of a box-like structure are provided with access notches extending thereinto from the open edges of the container which also is formed from a blank of paper-like stock that has been suitably creased and incised.

Another example of carton formed from paper sheet stock material comprises the subject matter of prior U.S. Pat. No. 2,776,081 to Ringler, dated Jan. 1, 1957, and pertaining to a cigarette carton having a flap comprising a closure for the carton, the flap being incised relative to one side of the carton to facilitate the bending thereof incident to removing cigarettes from the carton, said incisions being angular to each other.

Still another prior U.S. Pat. No. 2,917,219, to Shimel, dated Dec. 15, 1959, shows a structure in which a container is folded from sheet paper stock material to form a box-like member having elongated notches in opposite sides which are three thicknesses of material and a telescoping cover also is from sheet material to extend over the top of the box-like container.

Two other prior U.S. Pat. Nos. 3,949,928 to Perkins, dated Apr. 13, 1978, and 4,125,189, in Fujimoto, dated Nov. 14, 1978, respectively show relatively thin box-like containers adapted to be slidably moved through an open end of a slip cover, both items being formed from sheet like material and folded in certain ways to form the finished product.

SUMMARY OF THE INVENTION

It is among the principal objects of the present invention to provide a record album and slip case therefor, both of which are cut and folded from sheet paper board stock to provide a relatively flat box-like container having similar side panels spaced apart a limited distance and having one open end provided with a relatively long access notch extending inward from the edges of the side panels of said container in which the access notch is formed and bounded therealong by smooth, reinforced edges resulting from tongues of the material being folded inwardly upon the inner surfaces of the side panels and secured thereto by adhesive, certain of the tongues being of substantial size to afford protective stiffness over a substantial area of the side panels, said tongues extending inward from the edges of the access notches, whereby no raw board edges appear on the boundaries of the open end and access notches therein, th slip case also being formed from similar board stock and of a shape complementary to that of the container and adapted to slidably receive the same through one open end of the case, the edges of the panel defining the open end being reinforced by narrow panels folded inwardly upon and secured to the side and edge panels of the case by adhesive, thereby providing smoothly rounded edges along the open end resulting from such folding of said narrow panels as aforesaid.

Another object of the invention is to form said notches by providing tongues of the material initially integral with and extending outwardly beyond said edges of the panels, and opposite sides of said tongue having incisions extending thereinto toward each other and angularly in a direction away from the outer edges of said opening to provide a generally tee-shaped tongue of substantial area and width, the stem of each tee-shaped tongue on said side panels being folded inwardly respectively onto the inner surface of said side panels and secured thereto by adhesive to form a smoothly rounded outer edge along the fold defining the innermost boundary of said access notches.

It is a further object of the invention to have said incisions shaped in a manner to form and define small flaps also foldable onto said side panels along lines extending angularly from the opposite ends of the fold of each tee-shaped tongue and also extending outwardly to the outer edge of each side panel which defines said opening, thereby providing smooth rounded edges for the entire length of said access notches and also reinforcement of very substantial areas of said side panels by doubling the thickness thereof where said tee-shaped tongues are disposed.

Still another object of the invention is to form said pair of side panels with a narrow edge panel extending therebetween in a foldable manner for the full length thereof and the opposite edge of one side panel also having a similar narrow edge panel foldably connected thereto between the edge flap and said edge of the side panel, thereby to provide a space of limited thickness between said side panels within which phonograph records may be contained and the ends of said narrow edge panels which are within the open end of the container having additional short tongues of said material foldably connected to said end and folded inwardly upon said narrow edge panels and affixed thereto to provide smooth rounded ends thereon to supplement the rounded edges of said access notches.

One further object of the invention is to include additional narrow bottom edge panels foldably connected to the end edges of the side panels which are opposite the open end and said narrow edge panels being adapted to folded in overlapping relationship and secured by adhesive to form a closed bottom for said container opposite the open end thereof.

Another object of the invention is to have the opposite ends of the head portions of the tee-shaped tongues respectively spaced a short distance inward from the opposite edges of the side panels to which they are connected and the length of the tee-shaped tongues outward from the folded ends thereof being at least half the length of said side panels from the open ends thereof to the opposite ends, whereby said tongues overlie substantially half of the area of the inner surfaces of said side panels.

Still another object of the invention is to form said incisions in a manner to provide triangular cutouts extending respectively from each side of said extensions on said side panels which form said tongues and extending into said side panels from a location where said extensions join the side panels, and an additional straight incision extending from an inner corner of each triangular incision in a direction perpendicular to the outer edge of said extension to define the stem of said tee-shaped tongue, the portion of each side panel formed adjacent said triangular cutout and said additional straight incision comprising small flaps which are folded onto said side panels to provide additional portions of the rounded edges of said access notches respectively extending angularly outward and away from the opposite ends of the rounded edge formed by the folds of said tongues.

Still another object of the invention ancillary to the foregoing is to arrange the outermost side of said triangular cutout so as to be parallel to the side edges of said side panels and spaced inwardly therefrom to form additional short tongues.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS OF THE INVENTION

Figure 1:
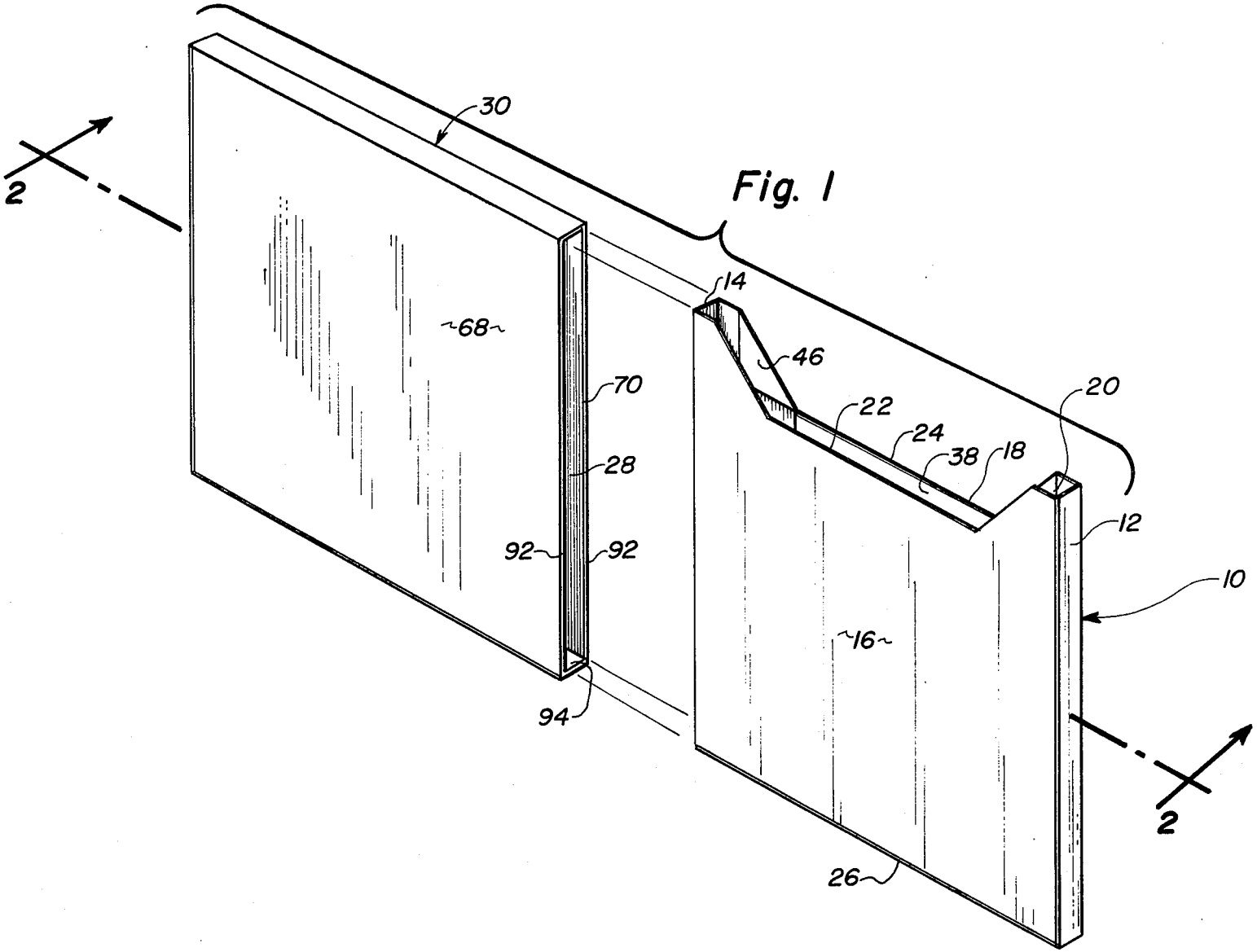
FIG. 1 is an exploded perspective view showing a record album in the form of a container having a relatively long access notch in the open end thereof and adapted to be slidable moved in an open end of a slip case.

Referring to FIG. 1, there is shown therein, in expanded perspective manner, a phonograph record album 10 formed from sheet paper board stock of suitable thickness and comprising a relatively flat, box-like container having relatively narrow opposite side edges 12 and 14 of limited width to provide a space of limited thickness between opposite side panels 16 and 18 for the accommodation of one or more phonograph records. The album 10 is provided with an open end 20 to receive such phonograph records and the side panels 16 and 18 adjacent the open end are provided with similar relatively long access notches 22 and 24. The opposite end or bottom 26 of the container forming the record album 10 is closed.

The record album 10 is adapted to be slidably moved through the open end 28 of slip case 30, the dimensions of which are such that they are complementary to those of the record album 10 in order to readily contain the same and all edges of the slip case 30 are closed except the open end 28.

Figure 4:
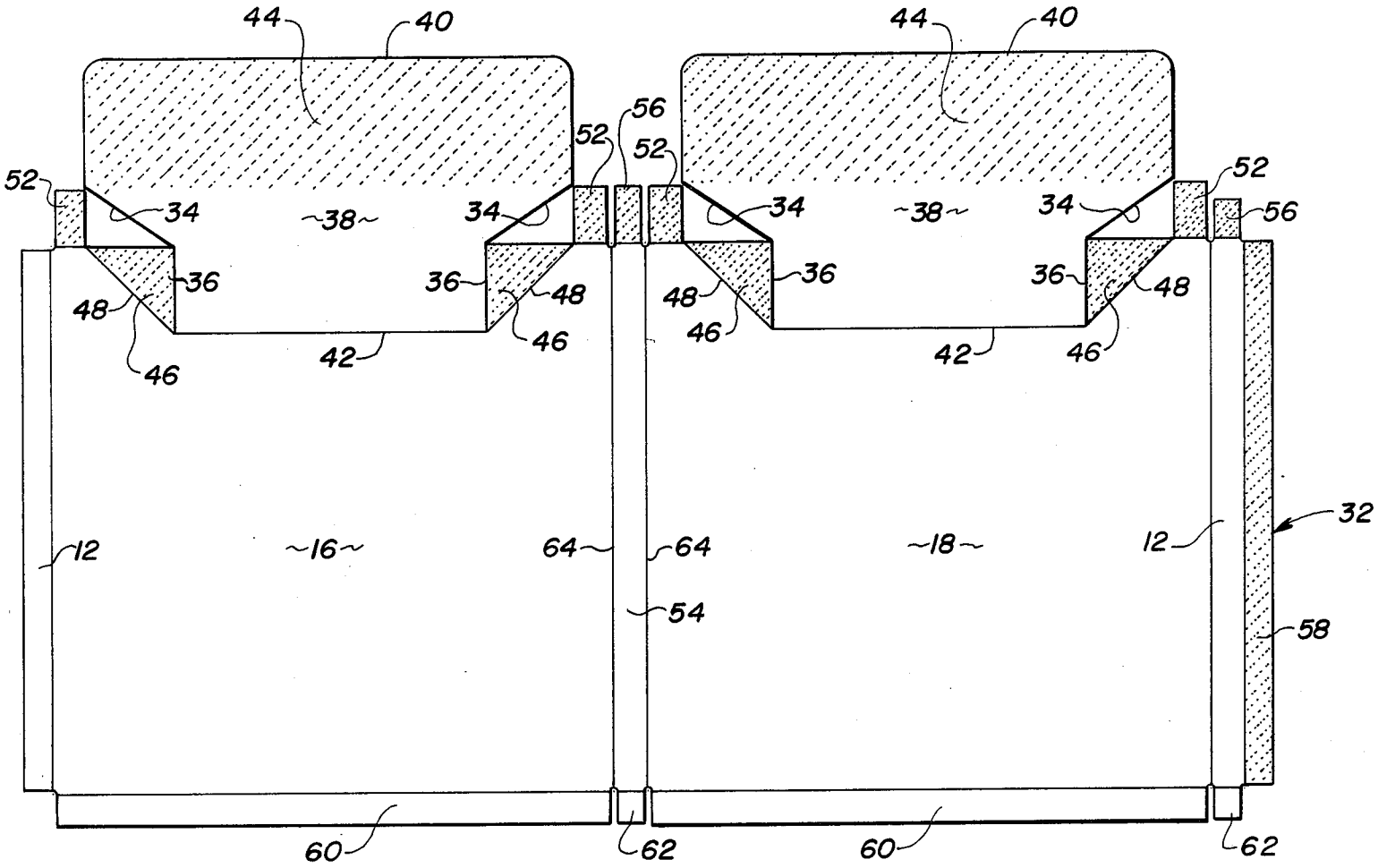
FIG. 4 is a view similar to FIG. 3 except that it illustrates a blank from which the record album shown in FIGS. 1 and 2 is formed, areas to which adhesive is applied being illustrated in broken diagonal lines.

Referring to FIG. 4, the container comprising record album 10 is formed from a blank 32, preferably cut from an extensive length of stock material of predetermined width which is such that minimum unused waste material is formed from the stock material incident to forming the blank 32. Accordingly, the width of the stock material is either equal to that of the blank 32, considered in either direction, or multiples thereof, also giving consideration to the type and capability of the machine upon which the blanks are formed. Preferably, the blanks are appropriately die-cut by the machine to form all the components of the blank illustrated in FIG. 4, including angularly related incisions which form triangular-shaped cutouts 34 which are dropped from the blanks and additional incisions 36, which are parallel to each other and extend from the inner apex of said angularly related incisions, are formed in the blank to define a tongue 38 which actually comprises extensions 40 projecting from similar edges of the side panels 16 and 18.

Figure 2:
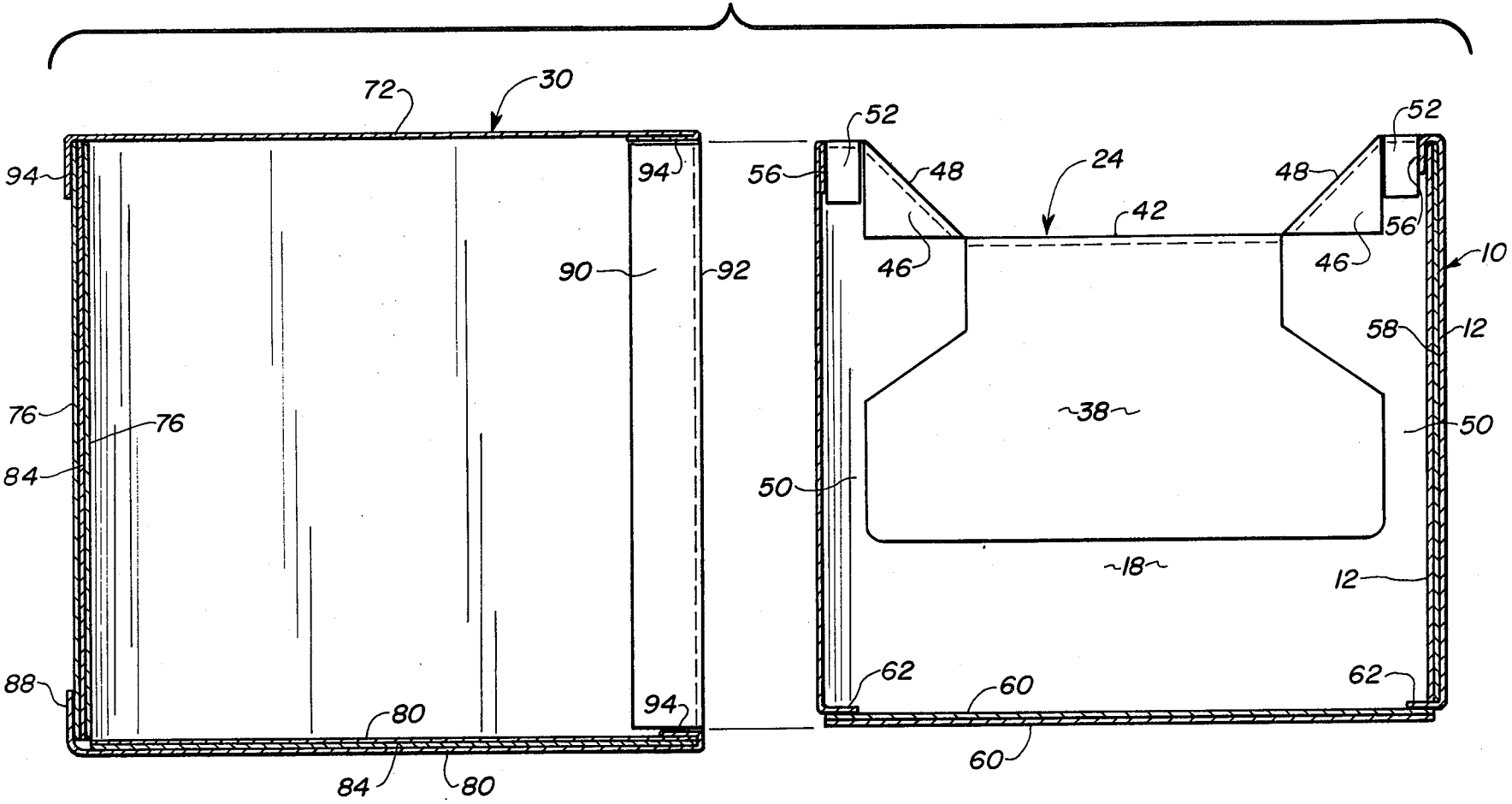
FIG. 2 is a vertical sectional view of the exploded view shown in FIG. 1 as seen in the direction of the arrows on the line 2—2 shown in FIG. 1.

The tongues 40 are foldable along lines 42 to dispose the same flatly against the side panel, such as panel 18 shown in FIG. 2, and secured thereto by appropriate adhesive 44 illustrated substantially in areas thereof in FIG. 4. Especially from FIG. 2 it will be seen that the tongues 38 cover approximately half of the side panel 18 against which it is disposed, thereby providing very substantial strengthening of the side panel, the opposite side panel 16 also being similarly reinforced. More importantly however, the folds along the line 42 provide a smoothly rounded edge in a manner to be reasonably strong as well as avoid the formation of a raw cut edge, thus minimizing injury to human fingers incident to handling records disposed within the album 10. The fold 42 also defines the innermost edge of the access notch 24.

To extend the rounded edge formation for the access notches 22 and 24, the blank 32, due to the triangular cutouts 34, in conjunction with the additional incisions 36, which are perpendicular with the outer edge of the extensions 40, form a small triangular flap 46 which also is coated with suitable adhesive and is folded along the diagnonal lines 48 which comprise angular extensions constituting the opposite ends of the access notches 22 to the side panels 16 and 18, additional to providing further reinforcement of the side panels adjacent the access notches.

From FIGS. 2 and 4, it also will be seen that the head portion of the T-shaped tongues 38 are slightly shorter than the width of the record album as indicated by the spaces 50 shown in FIG. 2. This results in the side panel 16 and 18, adjacent the open end thereof, being provided with additional short tongues 52 which are coated with adhesive and also are folded against the inner surfaces of the side panels as clearly shown in FIG. 2, the folded edges constituting further extensions of the folds 42 and 48, thereby provide the entire sides of the open end of the album 10 with smothly rounded edges and no raw cut edges.

Referring to FIG. 4, it will be seen that the side panels 16 and 18 are foldably connected by an intermediate narrow edge panel 54, the folds occurring along suitable crease lines formed in the blank in customary manner. Further, the opposite edges of the side panel 16 and 18 similarly are provided with a relatively narrow opposite side edges 12 which are of the same width as the edge manel 54, whereby when the side panels 16 and 18 are foled into parallel relationship, they are spaced apart by the side edge panels 12 and 54 to provide a record-receiving space of suitable thickness to receive one or more phonograph records. Also, one end of the narrow edge panel 54 is provided with a short tongue 56 which is folded inwardly and adhesively secured to the upper end of panel 54 as viewed in FIG. 4, further to complete the provision of the open end 20 of the record album 10 being entirely bounded by smothly rounded surfaces caused by the aforementioned folds.

The relatively narrow side edge panel 12 connected to side panel 18, for example, is additionally provided with an edge flap 58 upon which adhesive is spread and the same is folded onto the surface of the edge panel 12 corresponding to the surface of side panel 18 against which the tee-shaped tongue 38 is folded when the blank is flat.

The bottom end edges of the side panel 16 and 18 which are opposite the edges to which the tongues 38 are connected are also provided with bottom flaps 60 and corresponding ends of the edge panel 54 and one of the edge panels 12 have short tongues 62 foldably connected thereto.

To assemble the blank 32 into a finished record album container, the tee-shaped tongues 38 and small triangular flaps 46, after adhesive is applied thereto, are folded against the inner surfaces of the side panel 16 and 18, as are also the short tongues 52 and 56 with respect to the side panels and the connecting edge panel 54. Edge flap 58 then is folded onto the adjacent side edge 12 and affixed thereto by adhesive to form a narrow side edge panel of double thickness. The side panels 16 and 18 then respectively are folded along crease lines 64 to dispose the same in spaced parallel relationship with each other. The narrow edge panels 12, one of which now is of double thickness due to edge flap 58 being secured thereto, and the bottom flaps 60 then are all folded at right angles to the side panels 16 and 18 and appropriate adhesive is applied to the overlapping surfaces of the narrow side edge panels and bottom flap 60, the latter actually forming the closed end or bottom of the record album which is opposite the open end thereof. Lastly, short tongues 62 then have adhesive applied to them and are extended over the ends of the overlapping bottom flaps 60, if desired, or the same may be extended against the inner surface of the innermost edge flap 60 as shown in FIG. 2.

Figure 3:
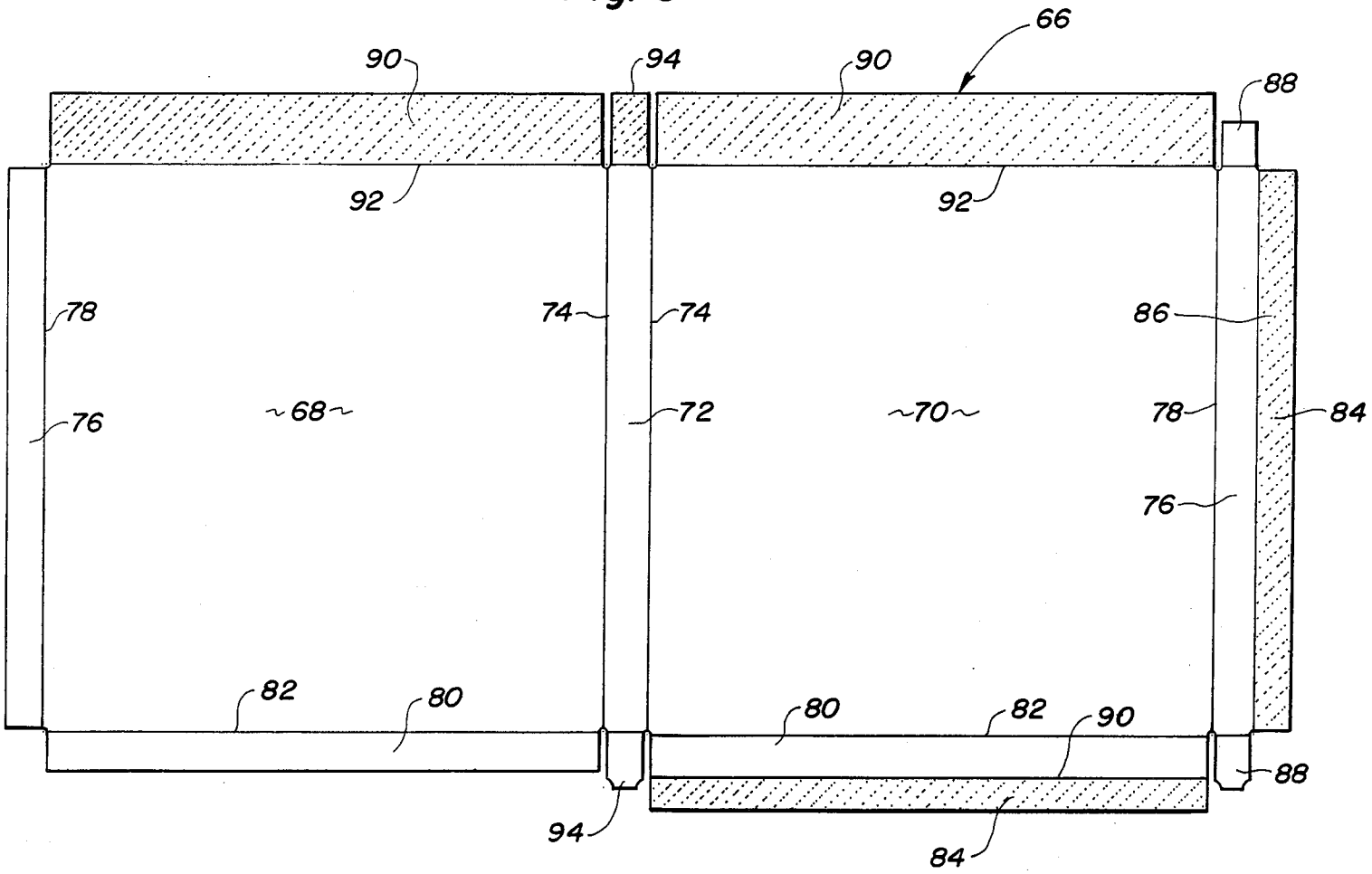
FIG. 3 is an open, flat blank from which the slip case shown in FIGS. 1 and 2 is formed and illustrated in broken diagonal line areas to which adhesive is to be applied.

Referring to FIG. 3 wherein blank 66 from which the slip case 30 is formed is illustrated, it is to be understood that the slip case, if desired, may be formed from the same type of paper board stock as the record album 10 or a different thickness may be employed if desired. The blank of the slip case comprises a pair of similar side panels 68 and 70, adjacent edges thereof being connected by a narrow edge panel 72 along creases 74, the width of the panel 72 being slightly greater than that of the panel 54 of the record album in order to provide the slip case with a space wide enough to receive the record album. Opposite end edges of the panel 68 and 70 have similar edge panels 78 foldably connected thereto along creases 78. Similar ends of the side panels 68 and 70 also have similar bottom flaps 80 foldably connected thereto along creases 82.

Connected to one of the edge panels 76 is an edge flap 84 defined by crease 86 and an end flap 88 extends from each end of the flap 84. Also, the bottom flap 80 on side panel 70 also has an edge flap 84 connected thereto along a crease and adhesive is applied to similar surfaces of the edge flaps 84.

The important feature of the slip case 30 is that the open end 28 thereof is surrounded by smoothly rounded surfaces formed by the folding of narrow reinforcing panels 90 along fold lines 92 and adhering the same by adhesive, shown by diagonal dotted line in FIG. 3, to adhere the reinforcing panels 90 against the inner surfaces of side panels 68 and 70, the narrow edge panel 72 also having a narrow reinforcing panel 94 on the end thereof aligned with panels 90 and similarly having adhesive to adhere the same against the inner surface of edge panel 72.

To assemble the slip cover, the edge flap 84 with adhesive thereon is folded onto edge panel 76 along crease 86. Similarly, the edge flap 84 is folded onto edge flap 30 and secured thereto by adhesive. Then the side panels 68 and 70 respectively are folded along creases 74 into spaced parallel relationship with each other, following which the edge flaps 80 and side edge panels 76 are folded into perpendicular relationship respectively with the edges of side panel 68 and 70 and are overlapped with each other and secured by adhesive. As a result of this, as shown in FIG. 2, the closed rear wall of the slip case comprises three thicknesses, as does the side wall opposite the edge panel 72, as also shown in FIG. 2 and end flaps 88 and 94 extend toward each other on the exterior of the slip case and are secured thereto by adhesive, as shown in FIG. 2.

From the foregoing, it will be seen that a strongly reinforced record album and slip case are provided by using minimum thicknesses of paper board stock and in particular, the elongated access notch provided in the open end of the record album container is bounded by smoothly rounded edges which are formed incident to also providing reinforcement for the side panels on which they exist. Likewise, the mouth or open end of the slip case similarly is reinforced by a double thickness and the open end is bounded by smoothly rounded ends formed by folds of the reinforcing panels which adhere to the inner surfaces of the side panels.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A blank for forming phonograph record albums from sheet paper board stock comprising in combination, a pair of similar generally rectangular side panels foldably connected along one edge and also having narrow rectangular panels along one end and opposite side edge of one side panel adapted to be secured to the opposite side panel to form a relatively flat container of limited thickness and having bottom flaps foldably connected to a lower edge of said side panels to form one closed end and an opposite open end to receive phonograph records, the upper edges of said side panels having similar relatively long access notches extending a limited distance into the edges of the side panels and defining said open end, said notches being formed by tongues of the material integral with and extending outwardly beyond said edges of the side panels forming the open end of the container and opposite sides of said tongues having incisions extending thereinto toward each other and angularly in a direction away from the outer edges of said tongues and additional parallel incisions extending into said panels from the inner ends of said angular incisions to form a stem of a generally tee-shaped tongue of substantial area and width, each tee-shaped tongue on said side panels being foldable inwardly respectively onto a common surface of said side panels and adapted to be secured thereto by adhesive to form a smoothly rounded edge along a fold defining the innermost boundary of said access notches, and said additional parallel incisions also forming one edge of small flaps foldable onto said common surface of said side panels along lines extending angularly from opposite ends of the fold of each tee-shaped tongue outwardly to the outer edge of each side panel which defines said opening whereby when said panels and small flaps have been folded smooth rounded edges for the entire length of said access notches are provided and also reinforcement of very substantial areas of said side panels is provided by doubling the thickness thereof where said tee-shaped tongues are disposed.

2. The record album according to claim 1 further characterized by said pair of side panels being foldable from opposite edges of a narrow edge panel extending the full length of the side edges of said side panels and said opposite edge of one side panel having a similar edge panel connected thereto between said opposite edge of said one side panel and the edge flap thereof to provide a space of limited thickness between said side panels within which phonograph records may be contained, and the ends of said narrow edge panels which are within the open end of the container when formed having additional short tongues of said material foldably connectable to said ends of said narrow edge panels and adapted to be folded inwardly upon said narrow edge panels and affixed thereto, thereby to provide smooth rounded ends upon said narrow edge panels to complement and continue the smooth rounded edges of the access notches of said open end of said container.

3. The record album according to claim 2 further including additional narrow end panels foldably connected to the bottom edges of the side panels which are opposite the ends of the side panels which form the open end and adapted to be folded in overlapping relationship with each other and adapted to be secured by adhesive to form a closed end for said container opposite the open end thereof.

4. The record album according to claim 1 wherein the opposite ends of the head portions of the tee-shaped tongues respectively are spaced a short distance inward from the opposite edges of the side panels to which they are connected and the length of the tee-shaped tongues outward from the folded ends thereof being at least half the length of the side panels from the open ends thereof to the opposite ends, whereby said tongues overlie substantially half the area of the inner surfaces of said side panels, and the portions of the ends of the side panels beyond the ends of the head of said tee-shaped tongues having additional short tongues foldable inward to form rounded edges.

5. The record album according to claim 4 in which said incisions are shaped to form a triangular cutout extending respectively from each side of said extensions on said side panels and extending into said side panels from where said extensions join the side panels and an additional straight incision extending from an inner corner of said triangle perpendicularly to the outer edge of said extension to define the stem of said tee-shaped tongue, the portion of each side panel formed adjacent said triangular cutout and said additional straight incision comprising small flaps which are folded onto said side panels to provide additional portions of the rounded edges of said access notches respectively extending angularly outward and away from the opposite ends of the rounded edge formed by the folds of said tongues.

6. The record album according to claim 5 in which the outermost side of said triangular cutout is parallel to the side edges of said side panels and spaced inwardly therefrom to form said additional short tongues.

7. The record album according to claim 1 further including a slip case complementary in size and shape to said record album and adapted to receive the same slidably through one open end, said slip case being formed from sheet paper board stock similar to that from which said album is formed and comprising a pair of side panels foldably connected along opposite edges of a narrow edge panel, additional narrow edge panels foldably connected to said side panels along the outer side edges and also the end edges thereof which are opposite said open end of said slip case, said narrow edge panels being foldable into overlapping relation and connected by adhesive, and the edges of said side panels and narrow connecting panels which form said open end having narrow reinforcing panels foldably connected to said edges and folded inwardly upon and secured to the inner surfaces of said side panels and narrow edge panel connected thereto to provide rounded outer edges to said open end of said slip case.

8. The record album and slip case according to claim 7 in which the side panels of said slip case are provided with still further narrow strengthening panels foldably connected respectively along the outer edges of said additional narrow edge panels connected respectively along one outer side edge and end edge of one of said side panels and adapted to be folded onto said additional narrow edge panels to which they are foldably connected and secured thereto by adhesive, thereby providing a double thickness to said respective additional narrow edge panels for being folded in overlapping relation onto the additional narrow edge panels on the side and end edges of said other side panel and thereby provide triple thicknesses to the side and end of the slip case respectively adjacent and opposite the open end of said slip case, and short end flaps foldably connected to the ends of the narrow connecting edge panel between said side panels and along one side of one of said side panels, said short end flaps being folded toward each other respectively over and secured to opposite ends of the overlapping additional narrow edge panels which are opposite the open end of the slip case.

9. A phonograph record album formed from sheet paper board stock and comprising in combination, a pair of similar rectangular side panels connected at one side edge and bottom edges by overlapping narrow rectangular side edge and bottom panels and the opposite side edges of said side panels being connected by a single narrow rectangular side panel foldably connected to said opposite side edges of said side panels and forming a relatively narrow container, the top edges of said side panels having relatively long access notches formed therein by tongues on the side panels which originally extended beyond the top edges of said side panels when in blank form, said tongues having stems which are narrower than the length of the tops of said tongues by means of incisions in said tongues and portions of said side panels extending angularly inward toward each other and downwardly a limited distance to a fold line spaced inward from and parallel to the open top of said container and along which said tongues are folded inwardly onto the inner surfaces of said side panels and affixed thereto by adhesive, said angular incisions also defining triangular flaps which also are folded inwardly against the inner surfaces of said side panels and affixed thereto by adhesive, thereby providing said access notches with rounded reinforced edges and the side panels with reinforcement on a major portion of the areas thereof to provide protection for records to be stored therein.

* * * * *